US005141236A

United States Patent [19]

Petitto

[11] Patent Number: 5,141,236

[45] Date of Patent: Aug. 25, 1992

[54] BALL PROJECTING AND CATCHING APPARATUS

[76] Inventor: John J. Petitto, 203 Hedge St., Clarksburg, W. Va. 26301

[21] Appl. No.: 791,193

[22] Filed: Nov. 13, 1991

[51] Int. Cl.[5] ..... A63B 65/12

[52] U.S. Cl. ..... 273/324

[58] Field of Search ..... 273/324, 318, 323; 124/16

[56] References Cited

U.S. PATENT DOCUMENTS

| | | | |
|---|---|---|---|
| 73,006 | 1/1868 | Hawkins | 273/324 |
| 163,294 | 5/1875 | Bass | 273/324 |
| 438,237 | 10/1890 | Holmes | 273/324 X |
| 721,953 | 3/1903 | Holmstrom | 273/323 |
| 865,246 | 9/1907 | Heltzel | 273/324 |
| 934,615 | 9/1909 | Ireland et al. | 273/324 |
| 1,034,716 | 8/1912 | Kruger | 273/324 |
| 1,210,847 | 1/1917 | Rubel | 273/324 |
| 1,570,632 | 1/1926 | Kideney | 273/323 |
| 2,126,628 | 8/1938 | Fiondella | 273/323 |
| 2,541,392 | 2/1951 | Weiss | 273/324 |
| 3,897,061 | 7/1975 | Grattan | 273/324 |

*Primary Examiner*—William H. Grieb

*Attorney, Agent, or Firm*—Laubscher, Presta & Laubscher

[57] ABSTRACT

A ball projecting and catching apparatus which includes a tubular body member, a flexible or flexible and resilient diaphragm member secured on the inside of the body member for catching and supporting a ball thereon, and partitioning the interior of the body member into upper and lower sections, means forming an axially central bore adjacent the bottom end of said body member, a plunger member positioned within said bore and having an impact end adjacent the diaphragm member and a handle end extending out of the bottom of the body member, and means for spring loading the plunger member to cause the plunger impact end to strike the diaphragm member when the handle end is pulled and released, thereby projecting a ball therefrom. The diaphragm member is constructed such that it sags toward the lower end of the body member forming a pocket for supporting a ball in the axial center of the body member. Preferably, the apparatus further includes a ring-shaped diaphragm retaining member, wherein the edge portion of the diaphragm member is wedged between the retaining member and the body member sidewall.

10 Claims, 1 Drawing Sheet

BALL PROJECTING AND CATCHING APPARATUS

BACKGROUND

The present invention relates to a toy amusement apparatus, and more particularly to a new and improved ball projecting and catching apparatus.

Games which involve projecting an object through the air and attempting to catch the object have proven to be a popular and enjoyable pastime for both adults and children. In order for a such a game to maintain its popularity, a game apparatus must be employed which can accurately project an object a considerable distance through the air while also readily allowing the projectile to be caught, thereby enabling player skill to be acquired and demonstrated during play. Therefore, a need has been created for a ball or other similar article projecting and catching apparatus which is efficient in operation, durable and relatively inexpensive to manufacture. The present invention meets this need.

BRIEF DESCRIPTION OF THE PRIOR ART

Various ball projecting and catching apparatuses are known in the patented prior art as evidenced by the patents to Bass U.S. Pat. No. 163,294, Kruger U.S. Pat. No. 1,034,716 and Rubel U.S. Pat. No. 1,210,847.

The patent to Kruger discloses a ball projecting and catching apparatus which includes a cone shaped ball receiving member and a spring loaded plunger mounted therein. The plunger includes a ball supporting end which moves with the plunger when a ball is shot therewith. A disadvantage of such a construction is that the plunger does not strike the ball, but instead pushes the ball from the apparatus, thereby not enabling the elasticity of the ball to contribute to the distance that the ball is shot. In addition, the plunger member may cause the ball to bounce out of the apparatus when attempting to catch the ball.

The patents to Bass and Rubel disclose toy cup and ball apparatuses which include a cup member for receiving a ball therein, and a spring loaded plunger for projecting a ball therefrom. The cup holds the ball in a stationary position while the plunger strikes the ball. While the elasticity of the ball is able to contribute to the distance that the ball is shot, a ball having high elasticity will tend to bounce out of the cup when it lands therein, particularly when the ball is traveling at high velocity The present invention was developed to overcome the disadvantages of the prior art by providing new and improved ball projecting and catching apparatus which is efficient in operation, durable and inexpensive to manufacture.

SUMMARY OF THE INVENTION

Accordingly, a primary object of the invention is to provide a ball projecting and catching apparatus which enables an elastic ball or other similar article to be shot a long distance into the air, while also reliably catching the ball without the chance of the ball bouncing out of the apparatus.

A more particular object of the invention is to provide a ball projecting and catching apparatus which includes a tubular body member, a flexible or flexible and resilient diaphragm member secured on the inside of the body member, and which partitions the interior of the body member into upper and lower sections, means forming an axially central bore adjacent the bottom end of said body member, a plunger member positioned within said bore handle end extending out of the bottom end of the body member, and means for spring loading the plunger member to cause the impact end to strike the diaphragm when the handle end is pulled and released, thereby projecting a ball therefrom.

Another object of the invention is to provide the diaphragm member such that it sags toward the lower end of the body member forming a pocket for supporting a ball in the axial center of the body member.

A further object of the invention is to further include a ring-shaped diaphragm retaining member positioned within the body member, wherein the edge of the diaphragm member is wedged between the retaining member and the sidewall of the body member.

DESCRIPTION OF THE DRAWING

Other objects and advantages of the subject invention will become apparent from a study of the following specification when viewed in light of the accompanying drawing, in which.

DETAILED DESCRIPTION

Figure 2:
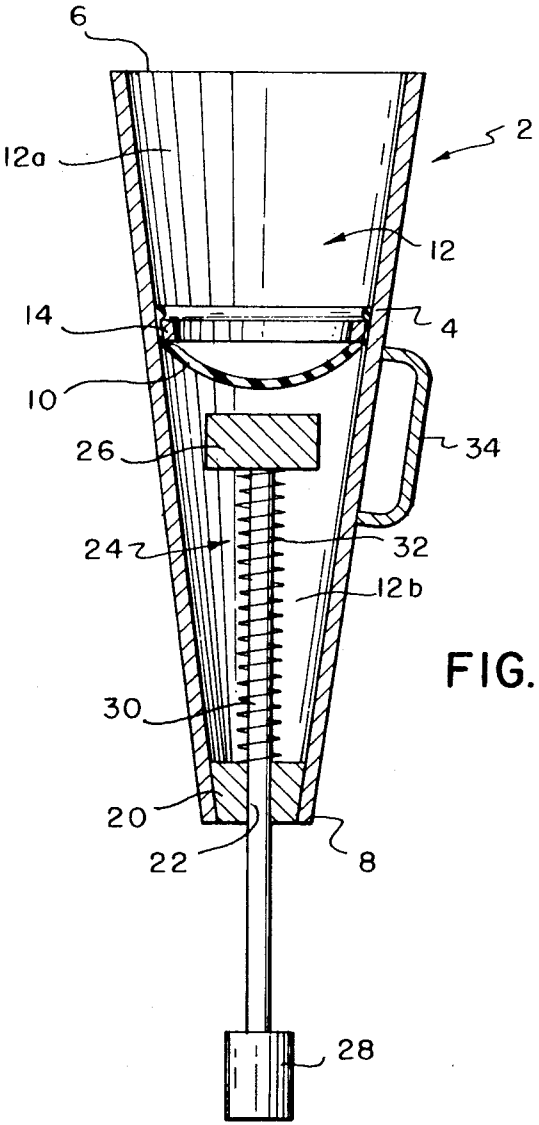
FIG. 2 is a sectional view of the apparatus of FIG. 1.
Figure 1:
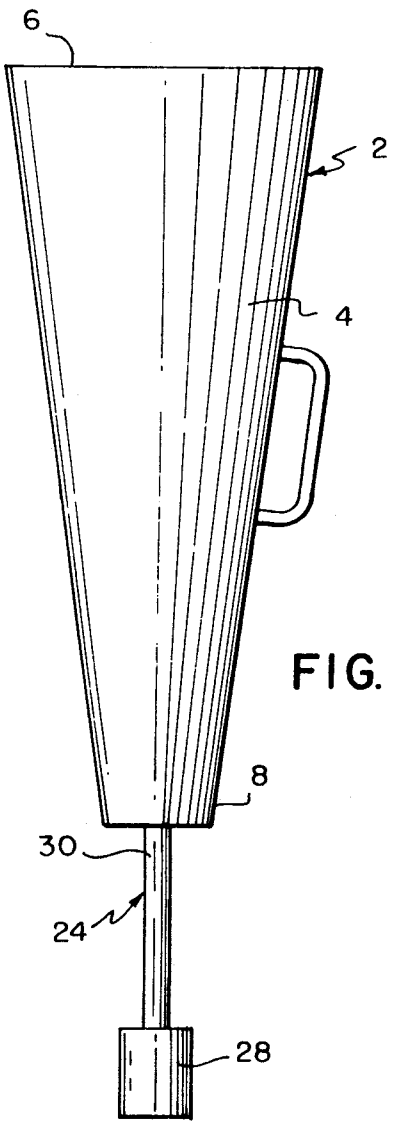
FIG. 1 is a front elevational view of the ball projecting and catching apparatus of the present invention.

Referring to FIGS. 1 and 2, there is shown the ball projecting and catching apparatus of the present invention, comprising a tubular body member 2 including a sidewall 4 defining a hollow interior chamber 12, a top open end 6 and a bottom end 8. The body member 2 may be made of any suitable light weight material such as plastic, aluminum, cardboard or the like. Preferably, the body member 2 has a frusto-conical shape wherein the sidewall 2 tapers inwardly from the top end 6 to the bottom end 8 thereof, thereby defining the top end 6 as a ball receiving and projecting end.

A flexible or flexible and resilient diaphragm member 10 is secured to the sidewall 4 within the chamber 12 intermediate the top end 6 and the bottom end 8. The diaphragm member 10 is constructed and positioned to partition the chamber 12 into upper and lower sections **12*a* and 12*b*, respectively. The diaphragm member 10 should be located at approximately $\frac{1}{3}$ to $\frac{2}{3}$ the distance between the two ends 6 and 8. The diaphragm member 10 may be constructed of any suitable flexible material such as rubber, fabric, leather, or the like. Preferably, the diaphragm member 10 sags slightly towards the bottom end 8 of the body member 2, thereby forming a pocket for catching and supporting a ball (not shown) in the axial center of the body member 2. The diaphragm member 10 is operable to absorb the energy of a ball being caught in the apparatus, thereby minimizing the chance of the ball bouncing out of the body member 2**.

Figure 3:
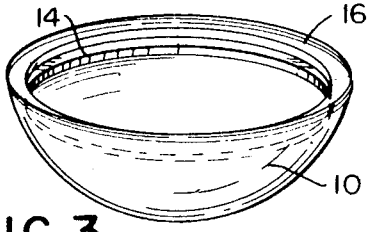
FIG. 3 is a perspective view of the diaphragm member and retaining member of the present invention.
Figure 4:
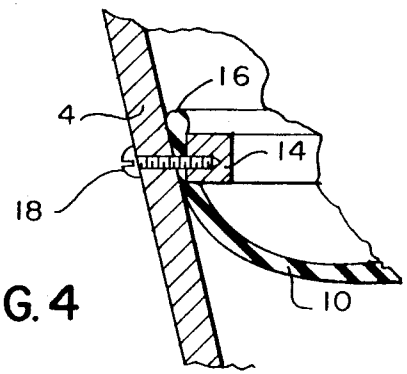
FIG. 4 is an partial, enlarged sectional view of the diaphragm member, retaining member and sidewall of the present invention with parts broken away.

The diaphragm member 10 may be secured to the sidewall 4 by any suitable means such as glue, screws, rivets or the like. Referring now more particularly to FIGS. 3 and 4, the diaphragm member 10 preferably is secured to the sidewall 4 through the use of a diaphragm retaining member 14. The retaining member 14 preferably is a ring-shaped member, and is operable to wedge the edge portion 16 of the diaphragm member 10 between the retaining member 14 and the sidewall 4 as shown in FIG. 4, thereby securely retaining the diaphragm member 10 in its desired position The ring-shaped retaining member 14 provides a simple means for installing the diaphragm member 10 within the body member 2, and minimizes the chance that the diaphragm 10 will tear or break with use, by evenly securing the diaphragm 10 around its entire edge portion 16. The retaining member 14 may be held in place merely by wedging it against the sidewall 4 of the body member 2, or with additional fastening means such as screws 18 or the like.

The apparatus further includes means 20 forming an axially central bore 22 adjacent the bottom end 8 of the body member 4. Preferably, bore forming means 20 is a plug member formed of any suitable material such as plastic, rubber, wood or the like, and is secured to the body member sidewall 4 adjacent the bottom end 8. Plunger member 24 is provided which includes an impact end 26, handle end 28 and elongated mid-portion 30 therebetween. The mid-portion 30 extends through the central bore 22 such that the impact end 26 is positioned adjacent the diaphragm member 10, and the handle end 28 extends out from the bottom end 8 of the body member 2. The mid-portion 30 is in sliding engagement with the plug member 20. Means for spring loading the plunger member 24 is provided, wherein the spring loading means is operable to cause the plunger impact end 26 to strike the diaphragm member 10 when the plunger handle end 28 is pulled downwardly and released, thereby projecting a ball from the top end 6 of the body member 2. Preferably, the spring loading means is a helical spring 32 positioned around the mid-portion 30 of the plunger member 24 between the impact end 26 and the plug member 20.

Handle means 34 secured to the sidewall 4 external of the body member 4 may be provided for enabling the body member to be easily held in an upright position with a single hand while the other hand is used to operate the plunger member 24.

Preferably, a ball (not shown) having high elasticity is used with the apparatus to enable the ball to be shot a long distance through the air, but any type of ball or other similar article could be projected and caught with the apparatus.

A variety of games involving one or more persons can be played with the projecting and catching apparatus of the present invention. For example, two players at spaced locations each having an apparatus of the present invention could project a ball back and forth to each other and keep score by counting how many times the other person is able to catch the ball. Alternatively, a single person could project the ball into the air and attempt to catch it himself. In addition, the ball could be shot at a target such as a basketball hoop or the like to test a players skill and accuracy in shooting the ball. Also, a ball could be shot against a building or the like, and a player could attempt to catch the ball when it rebounds therefrom.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. A ball projecting and catching apparatus, comprising:

(A) a tubular body member including a sidewall defining a hollow interior chamber, a top open end and a bottom end;

(B) a flexible diaphragm member secured to said sidewall within said chamber intermediate said top and said bottom ends, said diaphragm member partitioning said chamber into upper and lower sections;

(C) means forming an axially central bore within said chamber adjacent said bottom end thereof;

(D) a plunger member including a impact end portion, a handle end portion and an elongated mid-portion therebetween, wherein said impact end portion is positioned within said lower section adjacent said diaphragm, said mid-portion extends through said bore and is in sliding engagement with said bore forming means, and said handle end portion extends out from said bottom end of said body member;

(E) means for spring loading said plunger member, wherein said spring loading means is operable to cause said impact end portion to strike said diaphragm member when said handle end portion is pulled downwardly and released, thereby projecting a ball supported on said diaphragm member out of said top end of said body member.

2. Apparatus as defined in claim 1, wherein said body member sidewall is tapered inwardly from said top end to said bottom end.

3. Apparatus as defined in claim 1, wherein said spring loading means is a helical spring positioned around said mid-portion of said plunger member between said bore forming means and said impact end.

4. Apparatus as defined in claim 1, wherein said diaphragm member sags toward said lower end of said body member forming a pocket for supporting a ball in the axial center of said body member.

5. Apparatus as defined in claim 1, wherein said diaphragm member is resilient.

6. Apparatus as defined in claim 5, wherein said diaphragm is made of a rubber material.

7. Apparatus as defined in claim 1, wherein said diaphragm member includes an edge portion, and further including a diaphragm retaining member positioned within said chamber, wherein said diaphragm edge portion is wedged between said retaining member and said sidewall.

8. Apparatus as defined in claim 7, wherein said retaining member is a ring-shaped member.

9. Apparatus as defined in claim 1, wherein said bore forming means is a plug member secured to said sidewall within said chamber adjacent said bottom end, said plug member having a central bore therethrough.

10. Apparatus as defined in claim 1, further including handle means secured to said sidewall external of said body member.

* * * * *